US006217463B1

(12) United States Patent
Maruko et al.

(10) Patent No.: US 6,217,463 B1
(45) **Date of Patent: *Apr. 17, 2001**

(54) GOLF BALL

(75) Inventors: Takashi Maruko; Hisashi Yamagishi; Atsushi Nakamura; Yutaka Masutani, all of Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/429,364

(22) Filed: Oct. 28, 1999

(30) Foreign Application Priority Data

Mar. 3, 1999 (JP) ..... 11-055320

(51) Int. Cl.[7] ..... A63B 37/06
(52) U.S. Cl. ..... 473/370
(58) Field of Search ..... 473/373, 376, 473/377, 378, 354, 370

(56) References Cited

U.S. PATENT DOCUMENTS 698,516 * 4/1902 Kempshall ..... 473/376
790,955 * 5/1905 Davis ..... 473/376
2,376,085 5/1945 Radford et al. .
5,439,227 8/1995 Egashira et al. .
5,490,674 2/1996 Hamada et al. .
5,692,973 12/1997 Dalton .
5,820,485 * 10/1998 Hwang ..... 473/378
5,984,807 * 11/1999 Wai et al. ..... 473/376

FOREIGN PATENT DOCUMENTS 9-285565 11/1997 (JP) .

* cited by examiner

*Primary Examiner*—Sebastiano Passaniti
*Assistant Examiner*—Raeann Gorden
(74) *Attorney, Agent, or Firm*—Sughrue, Mion, Zinn, Macpeak & Seas, PLLC

(57) ABSTRACT

In a golf ball whose outer layer cover is harder than the inner layer cover, convex ribs are formed on the inner surface of the outer layer cover such that the convex ribs intrude into the inner layer cover. When the apexes of each spherical triangle of a hypothetical octahedron or icosahedron assumed on the inner surface of the outer layer cover are each represented by A, the center of the triangle is represented by B, the midpoint of each side of the triangle is represented by C, and a point on a line connecting the center B and each apex A is represented by D, a convex rib is arranged along each of a line between point A and point D, a line between point B and point D, and a line between point C and point D.

8 Claims, 9 Drawing Sheets

OCTAHEDRON

OCTAHEDRON

OCTAHEDRON

OCTAHEDRON

ICOSAHEDRON

GOLF BALL

BACKGROUND OF THE INVENTION

1. Field of the Invention

The present invention relates to a multi-layer solid golf ball comprising at least a core, an inner layer cover, and an outer layer cover. More particularly, it relates to a golf ball in which convex ribs are formed on the inner surface of the outer layer cover such that the convex ribs intrude into the inner layer cover.

2. Related Art

Various techniques have been studied and proposed for increasing travel distance of a golf ball and providing a player with an excellent feel upon hitting the golf ball (hereinafter may be called "hit feel"). Especially in a golf ball having a solid core and a cover, the hardness and size (diameter and thickness) of the core and the hardness and size of the cover are adjusted for such purposes.

For example, U.S. Pat. No. 5,439,227 discloses a three-piece golf ball which has a solid core, an inner layer cover, and an outer layer cover and in which the outer layer cover is made harder than the inner layer cover. Also, U.S. Pat. No. 5,490,674 discloses a three-piece golf ball which has inner and outer solid cores covered with a cover and in which the inner solid core is made harder than the outer solid core.

In the above-described golf balls, the boundary surface of each layer is generally a smooth spherical surface having neither projections nor depressions. However, U.S. Pat. Nos. 2,376,085 and 5,692,973 disclose a golf ball which has on its solid core projections for preventing eccentricity of the solid core, which eccentricity could otherwise arise when a cover is formed around the core through injection molding.

The projections on the solid core of the above-described golf ball are designed to substitute support pins used in an injection molding process, and the effect obtained by the shape of the support-pin-shaped projections is not utilized to improve the performance of the golf ball. In other words, the inventions of U.S. Pat. Nos. 2,376,085 and 5,692,973 relate to a technique for preventing eccentricity of the solid core and preventing mixture of a different material into the cover. According to the technique, by employment of the same material as used for the cover, projections are formed on the core surface such that the cover has a uniform thickness, and the projections and the cover are thus united. As described above, the projections are not designed to improve the performance of the golf ball.

Also, Japanese Patent Application Laid-Open (kokai) No. 9-285565 discloses a two-piece golf ball which has projections and depressions between a solid core and a cover, between two adjacent layers of a multi-layer solid core, or between two adjacent layers of a multi-layer cover. The two-piece golf ball provides a player with different hit feels, depending on the direction of an external force acting on the golf ball during hitting.

The two-piece golf ball has improved in terms of hit feel provided to a player. However, the travel performance and durability are not satisfactory, and there is room for further improvement.

SUMMARY OF THE INVENTION

In view of the foregoing, an object of the present invention is to provide a golf ball in which convex ribs are formed on the inner surface of an outer layer cover such that the convex ribs intrude into an inner layer cover, which has an improved travel performance and controllability, as compared with a conventional golf ball, and which provides a player with an improved hit feel as compared with a conventional golf ball.

In order to achieve the above object, the present inventors have conducted earnest studies, taking notice that when the effect of the configuration at a boundary between the inner layer cover and the outer layer cover of a golf ball; i.e. the cross-sectional, two-dimensional moment of a member that constitutes each of the convex ribs is increased, the bending strength of the member can be increased with no corresponding increase in hardness.

As a result, the present inventors found the following. When convex ribs are formed on the inner surface of the outer layer cover such that the convex ribs intrude into the inner layer cover and that the hardness of the outer layer cover is made greater than that of the inner layer cover, the bending strength of the member—which constitutes the convex ribs—increases because of the effect of the rib shape. As a result, when the golf ball is hit at a relatively high head speed by use of a driver or a like club, the degree of backspin of the golf ball decreases and the travel distance increases accordingly. When the golf ball is hit at a relatively low head speed by use of a short iron or a like club, the hardness of the member does not exceed a level of hardness in conventional golf balls, yielding excellent controllability and providing a soft hit feel.

Moreover, the present inventors conducted further studies and found that when convex ribs are arranged in a network pattern in accordance with a specific manner as described below, while a regular octahedron or icosahedron assumed on the inner surface of the outer layer cover is utilized, travel distance is increased, controllability is improved, and a player is provided with an improved hit feel. In addition, since the convex ribs are arranged uniformly, the effect of the rib shape for increasing strength is maximized efficiently, and the symmetry of a golf ball is secured easily.

The present invention was accomplished on the basis of the above-described findings, and provides the following golf balls (1)–(4).

(1) A golf ball comprising at least a core, an inner layer cover and an outer layer cover, in which convex ribs are formed on the inner surface of the outer layer cover such that the convex ribs intrude into the inner layer cover; the hardness of the outer layer cover is greater than that of the inner layer cover; and the convex ribs are arranged in a network pattern such that when the apexes of each spherical triangle of a hypothetical octahedron or icosahedron assumed on the inner surface of the outer layer cover are each represented by A, the center of the triangle is represented by B, the midpoint of each side of the triangle is represented by C, and a point on a line connecting the center B and each apex A is represented by D, a convex rib is arranged along each of a line between point A and point D, a line between point B and point D, and a line between point C and point D.

(2) A golf ball comprising at least a core, an inner layer cover and an outer layer cover, in which convex ribs are formed on the inner surface of the outer layer cover such that the convex ribs intrude into the inner layer cover; the hardness of the outer layer cover is greater than that of the inner layer cover; and the convex ribs are arranged in a network pattern such that when the apexes of each spherical triangle of a hypothetical octahedron or icosahedron assumed on the inner surface of the outer layer cover are each represented by A, the center of the triangle is represented by B, the midpoint of each side of the triangle is represented by C, and a point on a line connecting the center B and each apex A is represented by D, a convex rib is arranged along each of a line between point A and point D, a line between point B and point C, and a line between point C and point D.

(3) A golf ball comprising at least a core, an inner layer cover and an outer layer cover, in which convex ribs are formed on the inner surface of the outer layer cover such that the convex ribs intrude into the inner layer cover; the hardness of the outer layer cover is greater than that of the inner layer cover; and the convex ribs are arranged in a network pattern such that when the apexes of each spherical triangle of a hypothetical octahedron or icosahedron assumed on the inner surface of the outer layer cover are each represented by A, the center of the triangle is represented by B, points that trisect each side of the triangle are each represented by E, a convex rib is arranged along each of a line between point A and point E, a line between point B and point E, and a line between point E and another point E.

(4) A golf ball comprising at least a core, an inner layer cover and an outer layer cover, in which convex ribs are formed on the inner surface of the outer layer cover such that the convex ribs intrude into the inner layer cover; the hardness of the outer layer cover is greater than that of the inner layer cover; and the convex ribs are arranged in a network pattern such that when that when the apexes of each spherical triangle of a hypothetical octahedron or icosahedron assumed on the inner surface of the outer layer cover are each represented by A, and the midpoint of each side of the triangle is represented by C, a convex rib is arranged along each of a line between point A and point C, and a line between point C and another point C.

The golf ball according to the present invention has the following advantageous features:

(i) When the golf ball is hit at a relatively high head speed by use of a driver or a like club, the degree of backspin of the golf ball decreases, and the travel distance increases accordingly.

(ii) When the golf ball is hit at a relatively low head speed by use of a short iron or a like club, the degree of backspin increases, so that excellent controllably is maintained.

(iii) A player is provided with a soft feel when hitting the golf ball with a driver, and is provided with a firm and solid feel when hitting the golf ball with a short iron.

(iv) Since the convex ribs are arranged in a network pattern in accordance with a specific manner, while a regular octahedron or icosahedron assumed on the inner surface of the outer layer cover is utilized, travel distance is increased, controllability is improved, and a player is provided with an improved hit feel. In addition, the symmetry of a golf ball is secured easily, and molding is facilitated.

DETAILED DESCRIPTION OF THE PREFERRED EMBODIMENTS

Figure 1:
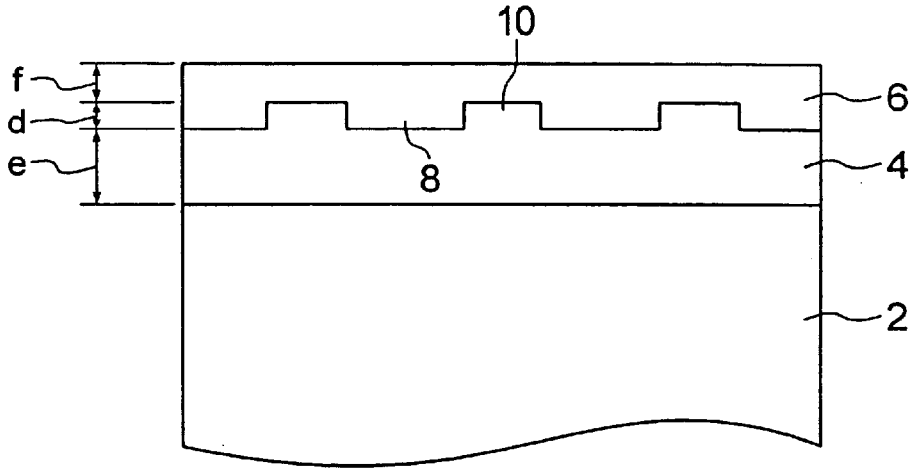
FIG. 1 is a sectional view schematically showing an exemplary golf ball according to the present invention.

The present invention will now be described in more detail with reference to the drawing. FIG. 1 is a cross sectional view which schematically shows an example of a golf ball according to the present invention. The golf ball comprises at least a solid core 2, an inner layer cover 4 which covers the core 2, and an outer layer cover 6 which covers the inner layer cover 4. The hardness of the outer layer cover 6 is greater than that of the inner layer cover 4.

In the present invention, when a load of 100 kg is applied to the core, the core preferably deforms in an amount of 2.5–8.0 mm, more preferably 2.5–6.0 mm. When the core deforms in an amount of less than 2.5 mm, the core is excessively hard, so that a good hit feel may not be obtained. When the core deforms in an amount of more than 8.0 mm, the core is too soft to obtain a sufficient degree of the resilience.

The outer layer cover preferably has a hardness of 56 or more, more preferably 58–68, in Shore D hardness. The difference in hardness between the outer layer cover and the inner layer cover is suitably 5 or more, preferably 10 or more in Shore D hardness. When the outer layer cover has a hardness of less than 56 in Shore D hardness, the outer layer cover is too soft to yield the effect of the rib shape to a sufficient level. When the outer layer cover has a hardness of more than 68 in Shore D hardness, durability problems, for example, a break in the cover, may arise. If the difference in hardness between the outer layer cover and the inner layer cover is less than 5, the difference is too small to yield the effect of the rib shape to a sufficient level.

In the golf ball according to the present invention, the convex ribs 8 are formed on the inner surface of the outer layer cover 6 such that the ribs 8 intrude into the inner layer cover 4. In this case, the convex ribs are formed in a network pattern of Arrangements 1–4 described below.

Figure 2:
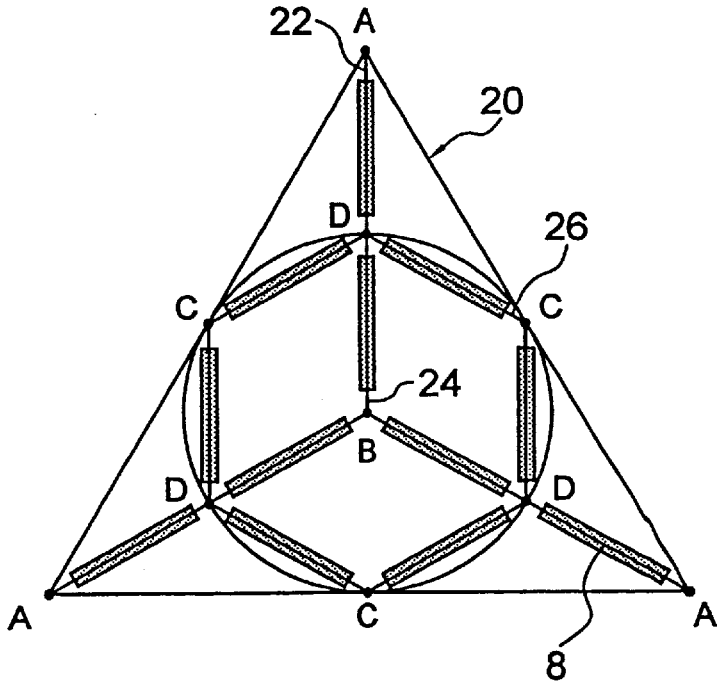
FIG. 2 is an explanatory view showing an example in which ribs are arranged in a network pattern.
Figure 3:
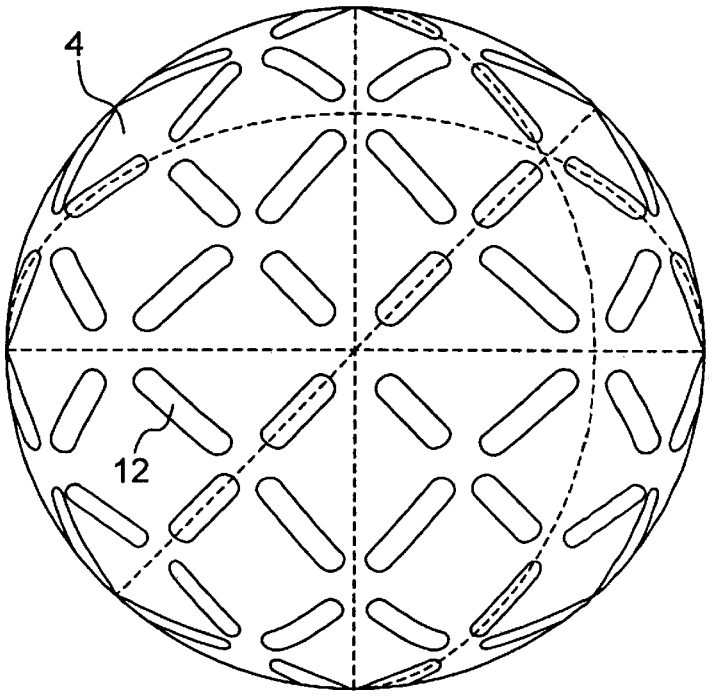
FIG. 3 is a plan view showing an example in which the outer surface of an inner layer cover has depressions corresponding to ribs formed on the inner surface of an outer layer cover.

Arrangement 1:

As shown in FIG. 2, when the apexes of each spherical triangle 20 of a hypothetical octahedron or icosahedron assumed on the inner surface of the outer layer cover are each represented by A, the center (inner center; the center of an inscribed circle) of the triangle is represented by B, the midpoint of each side of the triangle is represented by C, and a point (in this case, the midpoint) on a line connecting the center B and each apex A is represented by D, each of the ribs 8 is arranged along each of a line 22 between point A and point D, a line 24 between point B and point D, and a line 26 between point C and point D. FIG. 3 shows a specific example of Arrangement 1, in which depressions 12 corresponding to the convex ribs to be formed on the inner surface of the outer layer cover are formed on the outer surface of the inner layer cover 4 in accordance with Arrangement 1 which is determined while a regular octahedron is assumed on the inner surface of the outer layer cover.

Figure 4:
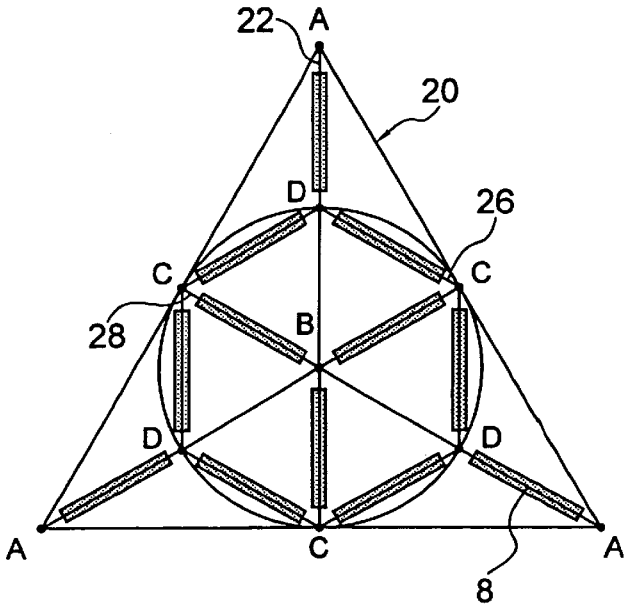
FIG. 4 is an explanatory view showing an example in which ribs are arranged in a network pattern.
Figure 5:
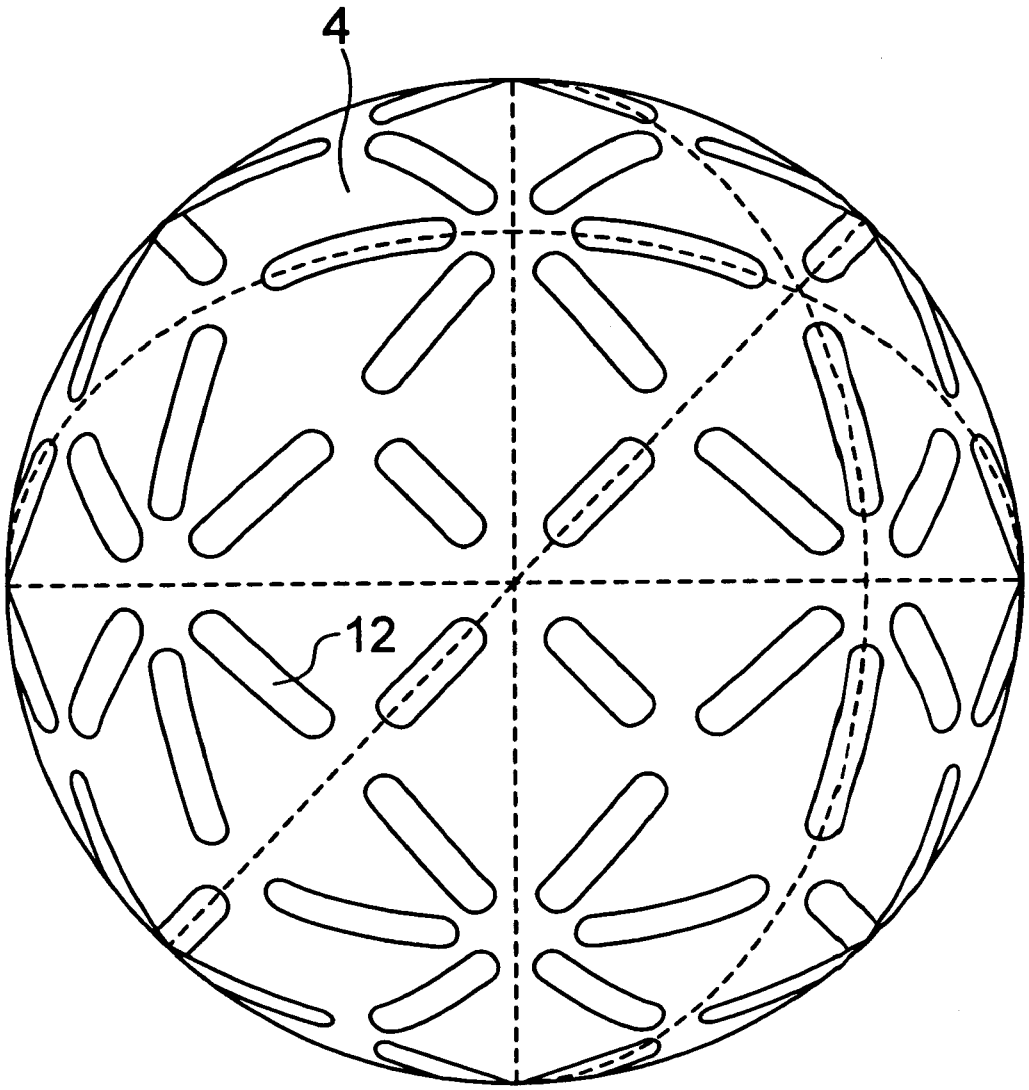
FIG. 5 is a plan view showing an example in which the outer surface of an inner layer cover has depressions corresponding to ribs formed on the inner surface of an outer layer cover.

Arrangement 2:

As shown in FIG. 4, when the apexes of each spherical triangle 20 of a hypothetical octahedron or icosahedron assumed on the inner surface of the outer layer cover are each represented by A, the center of the triangle is represented by B, the midpoint of each side of the triangle is represented by C, and a point (in this case, the midpoint) on a line connecting the center B and each apex A is represented by D, each of the ribs 8 is arranged along each of a line 22 between point A and point D, a line 28 between point B and point C, and a line 26 between point C and point D. FIG. 5 shows a specific example of Arrangement 2, in which depressions 12 corresponding to the convex ribs formed on the inner surface of the outer layer cover are formed on the outer surface of the inner layer cover 4 in accordance with Arrangement 2 which is determined while a regular octahedron is assumed on the inner surface of the outer layer cover.

Figure 6:
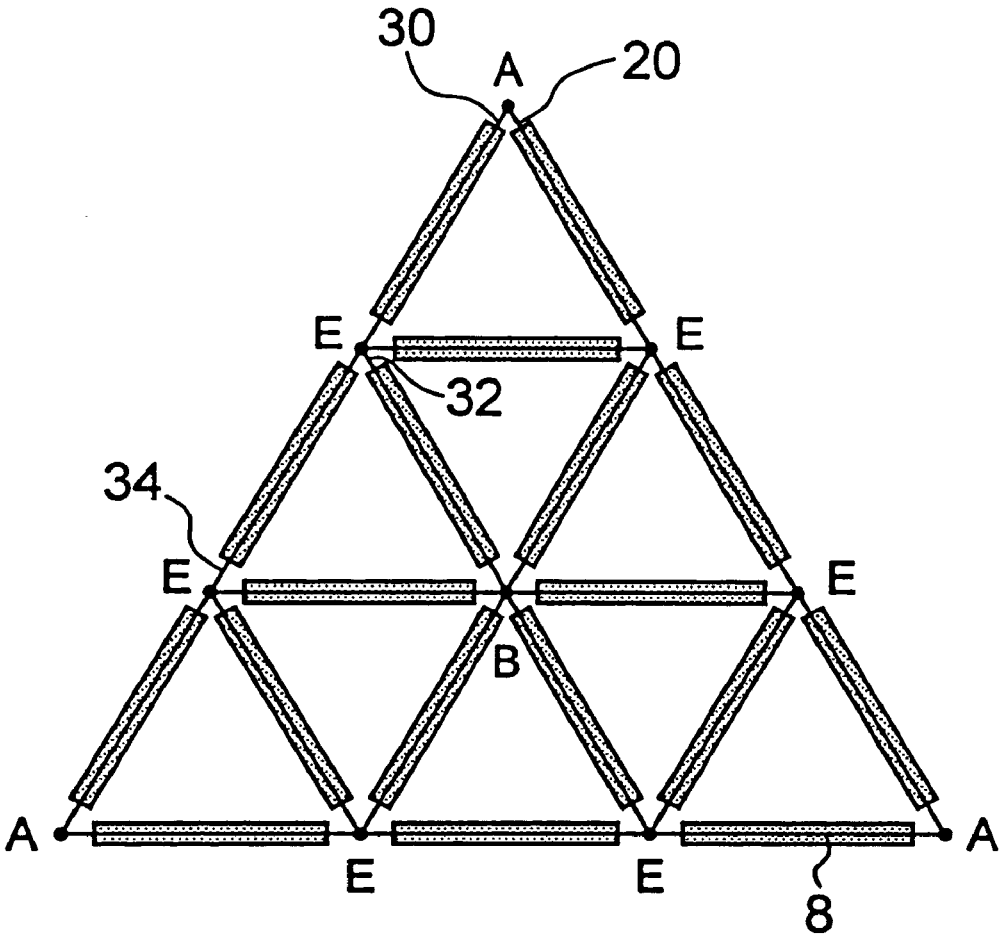
FIG. 6 is an explanatory view showing an example in which ribs are arranged in a network pattern.
Figure 7:
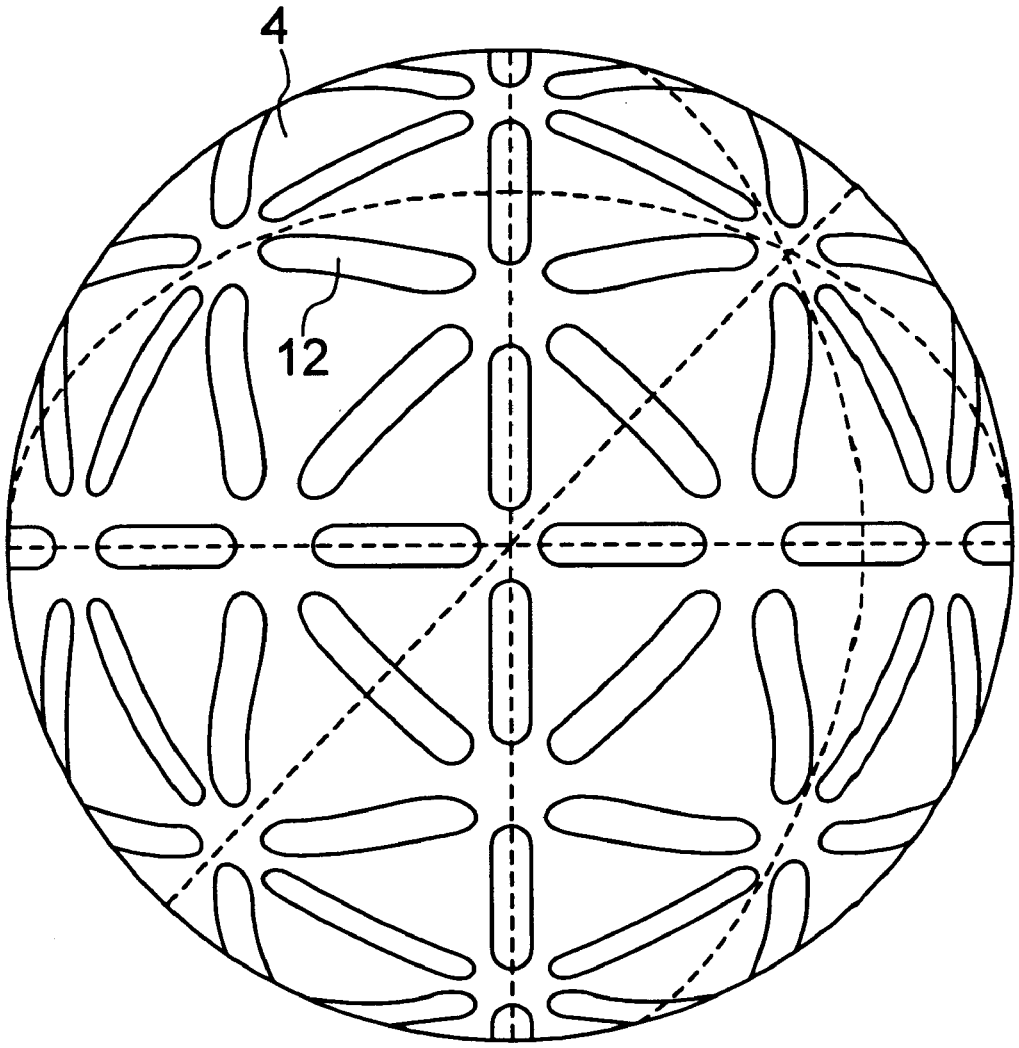
FIG. 7 is a plan view showing an example in which the outer surface of an inner layer cover has depressions corresponding to ribs formed on the inner surface of an outer layer cover.

Arrangement 3:

As shown in FIG. 6, when the apexes of each spherical triangle 20 of a hypothetical octahedron or icosahedron assumed on the inner surface of the outer layer cover are each represented by A, the center (inner center; the center of an inscribed circle) the triangle is represented by B, and points which trisect each side of the triangle are each represented by E, each of the ribs 8 is formed along each of a line 30 between point A and point E, a line 32 between point B and point E, and a line 34 between point E and another point E. FIG. 7 shows a specific example of Arrangement 3, in which depressions 12 corresponding to the convex ribs to be formed on the inner surface of the outer layer cover are formed on the outer surface of the inner layer cover 4 in accordance with Arrangement 3 which is determined while a regular octahedron is assumed on the inner surface of the outer layer cover.

Figure 8:
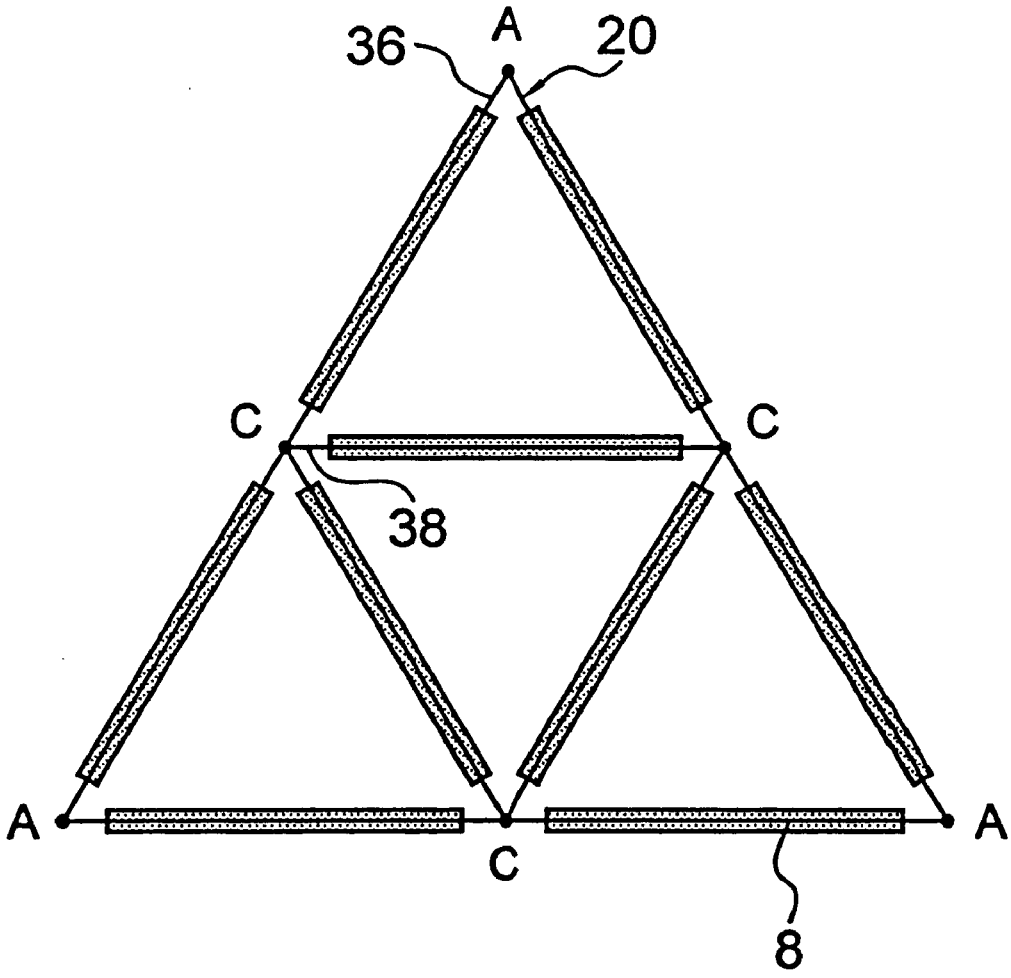
FIG. 8 is an explanatory view showing an example in which ribs are arranged in a network pattern.
Figure 9:
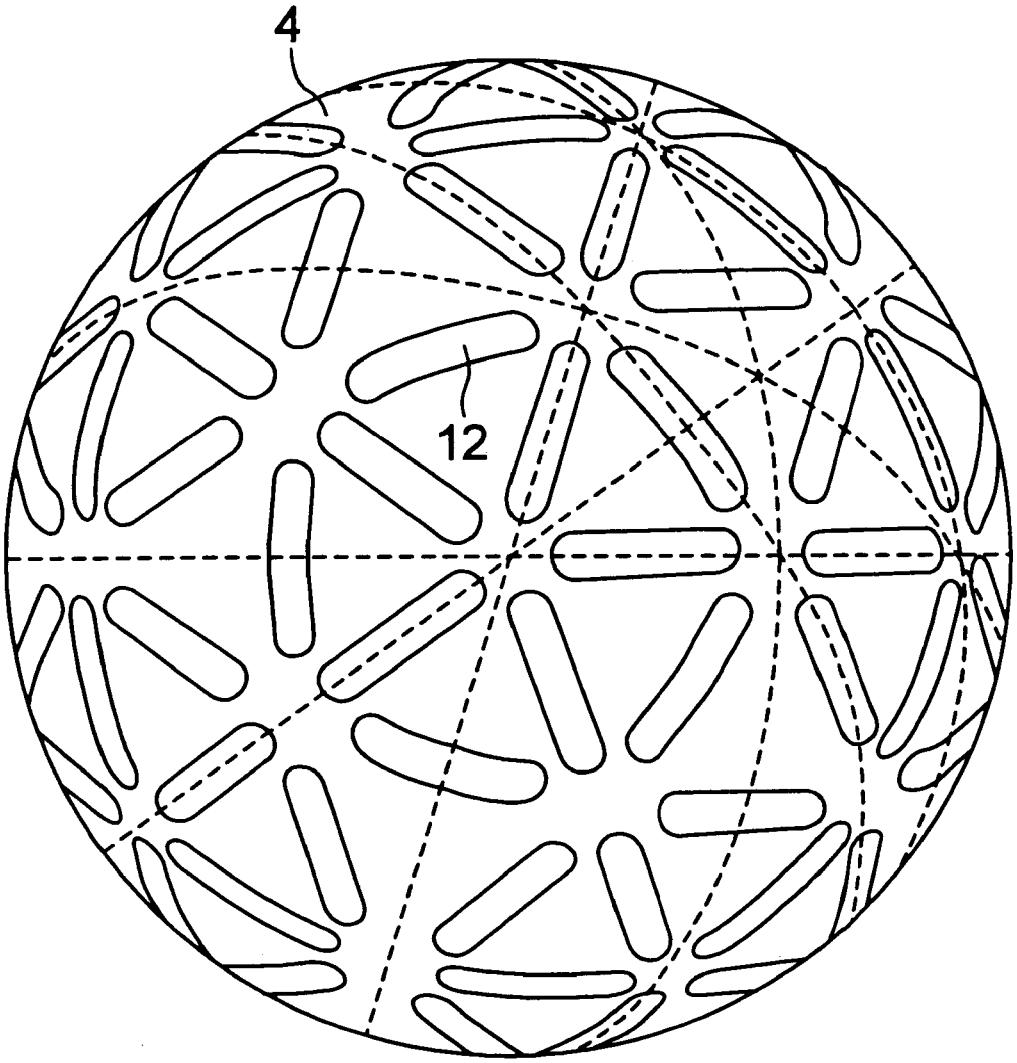
FIG. 9 is a plan view showing an example in which the outer surface of an inner layer cover has depressions corresponding to ribs formed on the inner surface of an outer layer cover.

Arrangement 4:

As shown in FIG. 8, when the apexes of each spherical triangle 20 of a hypothetical octahedron or icosahedron assumed on the inner surface of the outer layer cover are each represented by A, and the midpoint of each side of the triangle is represented by C, each of the ribs 8 is arranged along each of a line 36 between point A and point C and a line 38 between point C and another point C. FIG. 9 shows a specific example of Arrangement 4, in which depressions 12 corresponding to the convex ribs to be formed on the inner surface of the outer layer cover are formed on the outer surface of the inner layer cover 4 in accordance with Arrangement 4 which is determined while a regular icosahedron is assumed on the inner surface of the outer layer cover.

Figure 10:
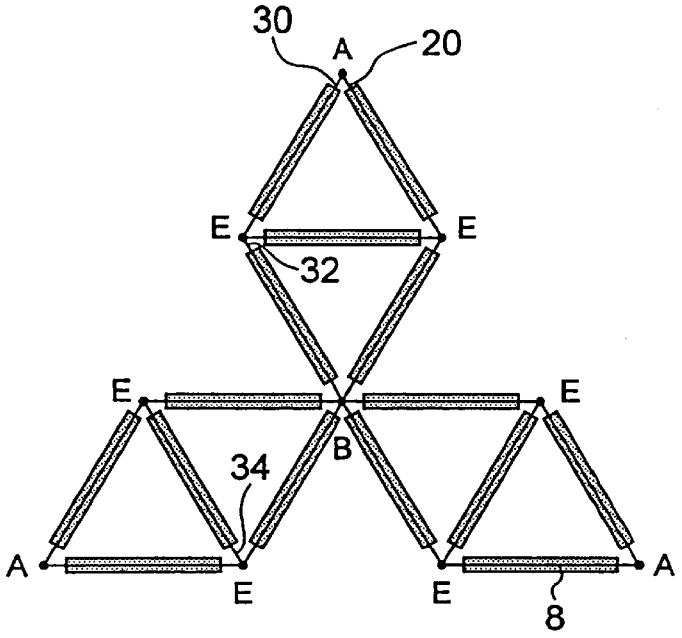
FIG. 10 is an explanatory view showing an example in which ribs are arranged in a network pattern.

In the present invention, insofar as the symmetry of the golf ball is maintained, the convex ribs may be arranged along a portion of the above-described lines. FIG. 10 shows an example of such arrangement, in which among the ribs arranged along the lines 34 each connecting point E and another point E of each spherical triangle 20 of the regular octahedron or icosahedron (shown in FIG. 6), the ribs arranged along the lines between point E and adjacent point E on the same side are removed.

Figure 11:
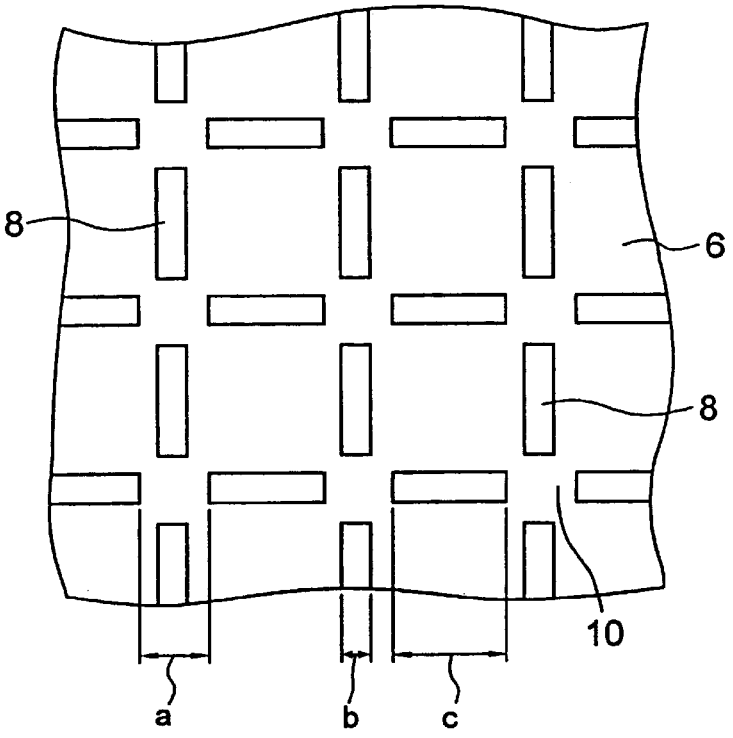
FIG. 11 is a plan view schematically showing the inner surface of an outer layer cover on which convex ribs are formed.

If necessary, the golf ball according to the present invention may be configured such that the ribs are arranged in a network pattern as described above, and a plurality of cutaway portions 10 are provided between the ribs 8, as shown in FIG. 11. When the cutaway portions 10 are formed, the travel distance is increased, the controllability is improved, and the hit feel is improved. Also, the cutaway portions serve as passages through which resin flows during injection molding process in which the inner layer cover is injection molded to have on its outer surface the depressions which correspond to the ribs. As a result, the inner layer cover is molded properly, imparting improved symmetry to the golf ball. In order to enable the cutaway portions 10 to function effectively as the flow passages, the cutaway portions are preferably formed such that the ribs 8 do not intersect each other and do not form any closed circle, as shown in FIG. 11.

The width a (the distance between two adjacent ribs 8, see FIG. 11) of the cutaway portions 10 is preferably 0.5–10.0 mm, more preferably 2.0–8.0 mm. When the width a of the cutaway portions is smaller than 0.5 mm, resin may not flow smoothly through the cutaway portions during injection molding. When the width of the cutaway portions is greater than 10.0 mm, the symmetry of the golf ball may deteriorates.

Figure 12:
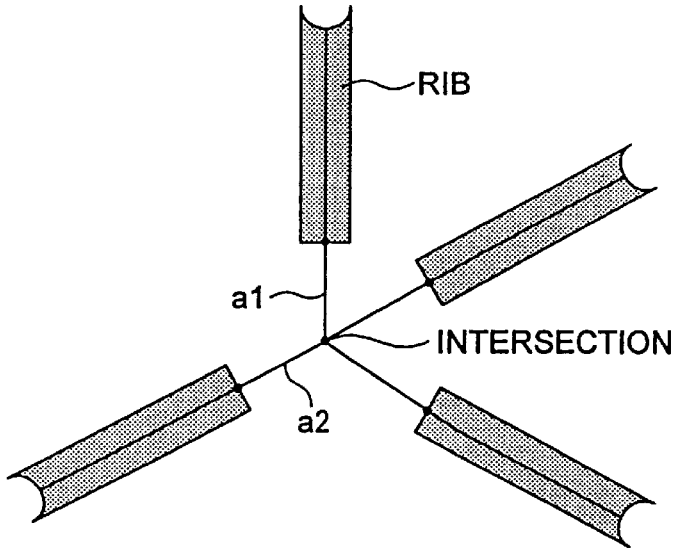
FIG. 12 is an explanatory view showing a method of determining the width of a cutaway portion when the axes of adjacent ribs do not form a straight line.

When the axes of adjacent ribs do not form a straight line as shown in FIGS. 2–10, the width a of the cutaway portions 10 (the distance between adjacent ribs 8) is a distance as measured through the intersection between the axes of the adjacent ribs 8, as shown in FIG. 12. That is, the width a of the cutaway portions 10 is the sum of distances a1 and a2.

The width b of the ribs 8 is preferably 0.3–2.5 mm, more preferably 0.5–2.0 mm. When the width b of the ribs 8 is less than 0.3 mm, the ribs 8 become excessively thin, so that the effect of the ribs may become insufficient. When the width of the ribs 8 is greater than 2.5 mm, the ribs 8 become excessively thick, so that the hit feel and the symmetry of the golf ball may deteriorate. The length c of the ribs 8 separated by means of the cutaway portions 10 is preferably 3.0–15.0 mm, more preferably 4.0–10.0 mm.

Figure 13A:
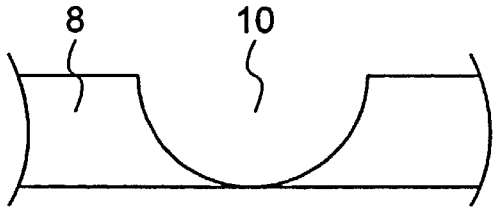
FIGS. 13(*a*), 13(*b*), and 13(*c*) are side views each showing an example of the shape of a cutaway portion.
Figure 13B:
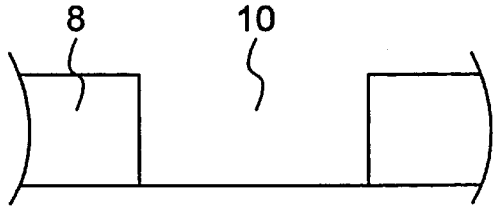
Figure 13C:
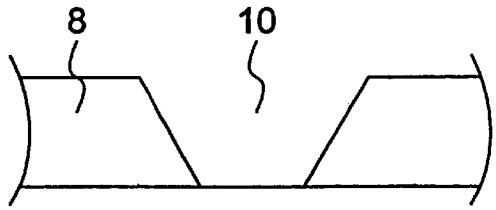

The cutaway portions 10 can be formed in an arbitrary shape through selection of tools used for fabrication of a mold. For example, each of the cutaway portions 10 may have a semicircular cross section (FIG. 13(*a*)), a rectangular cross section (FIG. 13(*b*)), or a trapezoidal cross section (FIG. 13(*c*)), when the rib 8 is viewed from a transverse direction.

The height d of the ribs 8 is preferably 0.3–1.0 times, more preferably 0.5–1.0 times the thickness e of the inner layer cover (see FIG. 1). When the ratio is less than 0.3 times, the height of the rib is excessively low, so that the effect of the ribs cannot be obtained sufficiently.

The thickness f of the outer layer cover 6 (the thickness excluding the height of the ribs 8) is preferably 0.5–3.0 mm, more preferably 0.8–2.5 mm. When the thickness f of the outer layer cover is less than 0.5 mm, the ribs may not be able to mold properly. When the thickness of the outer layer cover is more than 3.0 mm, the ribs are excessively thick, so that the hit feel may deteriorate.

Next, the composition of each layer of the golf ball according to the present invention will be described. In the golf ball, the solid core is formed of a base rubber material such as 1,4-cis-polybutadiene, polyisoprene, natural rubber, or silicone rubber. Especially, it is recommended to use 1,4-cis-polybutadiene as a main component in order to improve resilience.

A zinc or magnesium salt of an unsaturated fatty acid such as zinc methacrylate and zinc acrylate, or an ester compound such as trimethylpropane methacrylate may be added, as a cross-linking agent, to the base rubber material, and among them, zinc acrylate is particularly preferred, because zinc acrylate can increase resilience. These linking agents are preferably incorporated in an amount of 15–40 parts by weight based on 100 parts by weight of the above-described base rubber material. Also, a vulcanizing agent may be added in an amount of 0.1–5 parts by weight based on 100 parts by weight of the base rubber material.

If necessary, zinc oxide and/or barium sulfate may be added to the base rubber material, as an antioxidant or a filler for adjusting specific gravity. The amount of the filler is 5–130 parts by weight based on 100 parts by weight of the base rubber material.

The base rubber material (a rubber composition for the solid core) preferably has the following composition:

| | |
|---|---|
| 1,4-cis-polybutadiene | 100 parts by weight |
| zinc oxide | 5–40 parts by weight |
| zinc acrylate | 15–40 parts by weight |
| barium sulfate | 0–40 parts by weight |
| peroxide | 0.1–5.0 parts by weight |

Desirable vulcanization conditions; temperature: 150±10° C., vulcanization time: 5–20 minutes.

The above-described rubber composition for the solid core is kneaded by use of a conventional mixer (for example, a Banbury mixer, a kneader, or a roll). The thus-obtained compound is molded through injection molding or compression molding employing a mold for the core.

In the present invention, the core may has a multi-layer structure, for example, such that the core comprises an inner core and a surrounding layer which covers the inner core. The inner core may be formed from the same rubber composition as the above-described rubber composition for the core. The surrounding layer may be formed from a rubber material, but is preferably formed from a resin material such as an ionomer resin; an amide resin such as nylon; an urethane resin; or a polyester elastomer such as Hytrel. The ratio of the thickness (mm) of the surrounding layer to the diameter (mm) of the inner core preferably falls within the range of 1:9–1:72, more preferably 1:11–1:36.

The diameter of the solid core is preferably 29.0–38.0 mm, more preferably 30.0–37.0 mm, even more preferably 32.0–37.0 mm; the Shore D hardness is preferably 20–50, more preferably 25–45; and the weight is typically about 12–36.0 g.

No limitation is imposed on the material of the inner layer cover. Either resin or rubber may be used, but, in view of durability, a resin having a high impact resistance is preferably used. For example, polyester resin such as polyester elastomer, polyurethane resin, ionomer resin, styrene elastomer, hydrogenated butadiene resin, or a mixture of these materials can be used for the inner layer cover. Especially, it is recommended to use a polyester resin such as polyester elastomer or a polyurethane resin as a main component. Specifically, commercially available products such as Hytrel 3078, 4047, and 4767 (products of Toray DuPont) may be used. In this case, the hardness of the inner layer cover is preferably set to 10–50, more preferably 15–45 in Shore D hardness.

In the present invention, the ribs are formed such that the ribs extend from the inner surface of the outer layer cover toward the core; that is, the outer layer cover intrudes into the inner layer cover. In order to form the ribs in such a way, the depressions are preferably formed on the surface of the inner layer cover during the molding of the inner layer cover. Specifically, a mold for molding the inner layer cover is fabricated such that projections corresponding to the depressions are formed on the inner wall of the cavity of the mold, and the inner layer cover is molded in an ordinary manner by use of the mold. As a result, the core is covered with the inner layer cover, which has a large number of depressions on its outer surface.

Subsequently, the inner layer cover having the depressions on its surface is covered with a material for the outer layer cover through ordinary injection or compression molding (preferably injection molding), so that ribs are formed within the inner layer cover.

No particular limitation is imposed on the outer layer cover material, and a known outer layer cover material can be used. Examples of the outer layer cover material include ionomer resin, polyurethane resin, polyester resin, and balata rubber. However, ionomer resin is preferred; more specifically, commercially available products such as Surlyn (product of DuPont) and Himilan (product of DuPont Mitsui Polychemicals) may be used.

If necessary, titanium dioxide, barium sulfate, or any other suitable material may be added to the outer layer cover material for the purpose of, for example, adjustment of the specific gravity. Furthermore, if necessary, an UV absorber, an antioxidant, and a dispersant such as metallic soap may be added to the outer layer cover material. The outer layer cover may be formed of a single layer made of a single material or formed of two or more laminated layers made of different materials.

In the thus-obtained golf ball, many dimples are formed on its surface. If necessary, coating, stamping, and other finishing treatments are performed on the surface of the golf ball. The golf ball has a hardness such that when a load of 100 kg is applied to the golf ball, the ball preferably deforms in an amount of 2.6–4.0 mm, more preferably 2.8–3.8 mm. In compliance with the R&A golf rules, the golf ball is formed such that the golf ball has a diameter of 42.67 mm or greater and a weight of 45.93 g or less.

EXAMPLES

The present invention will be specifically described with reference to Examples and Comparative Examples. However, the present invention is not restricted to the Examples. All amounts shown in Table 1 represent parts by weight.

TABLE 1

| | | Examples | | | | | Comparative Examples | | | |
|---|---|---|---|---|---|---|---|---|---|---|
| | | 1 | 2 | 3 | 4 | 5 | 1 | 2 | 3 | 4 |
| Composition of core | 1,4-cis-Polybutadiene | 100.0 | 100.0 | 100.0 | 100.0 | 100.0 | 100.0 | 100.0 | 100.0 | 100.0 |
| | Zinc acrylate | 30.0 | 18.0 | 12.0 | 24.0 | 35.0 | 30.0 | 30.0 | 18.0 | 27.0 |
| | Zinc oxide | 5.0 | 5.0 | 5.0 | 5.0 | 5.0 | 5.0 | 5.0 | 5.0 | 5.0 |
| | Antioxidant | 0.2 | 0.2 | 0.2 | 0.2 | 0.2 | 0.2 | 0.2 | 0.2 | 0.2 |
| | Barium sulfate | 17.3 | 26.0 | 23.5 | 25.2 | 15.1 | 17.3 | 17.3 | 26.0 | 20.4 |
| | Dicumyl peroxide | 0.9 | 0.9 | 0.9 | 0.9 | 0.9 | 0.9 | 0.9 | 0.9 | 0.9 |
| Composition of inner layer cover | Hytrel 4047 | 100 | 60 | — | — | 100 | — | 100 | 60 | — |
| | Hytrel 4767 | — | 40 | 100 | — | — | — | — | 40 | — |
| | PANDEX T-2983 | — | — | — | 100 | — | — | — | — | — |
| | Himilan 1605 | — | — | — | — | — | 50 | — | — | — |
| | Himilan 1706 | — | — | — | — | — | 50 | — | — | — |
| | Barium sulfate | — | — | — | — | — | 24 | — | — | — |
| Composition of outer layer cover | Himilan 1557 | — | 40 | 50 | 40 | 25 | — | — | 40 | — |
| | Himilan 1601 | — | — | 50 | — | — | — | — | — | — |
| | Himilan 1605 | 50 | — | — | — | 50 | 50 | 50 | — | 50 |
| | Himilan 1706 | 50 | — | — | — | 25 | 50 | 50 | — | 50 |
| | Himilan 1855 | — | — | — | — | — | — | — | — | — |
| | Himilan 1856 | — | 60 | — | 60 | — | — | — | 60 | — |

Hytrel: product of Toray DuPont, polyester-based thermoplastic elastomer
Himilan: product of DuPont Mitsui Polychemicals, ionomer resin
PANDEX: product of Dainippon Ink and Chemicals, polyurethane elastomer

Examples and Comparative Examples

Golf balls of Examples 1–5 and Comparative Examples 1–4 were manufactured as follows. First, a solid core for each golf ball was produced. That is, a rubber composition for the solid core having a corresponding composition shown in Table 1 was kneaded by use of a kneader, and vulcanaized for about 15 minutes at 155° C. within a mold for the core.

Subsequently, a composition for an inner layer cover having a corresponding composition shown in Table 1 was kneaded and injection-molded around the solid core to thereby form the inner layer cover. Subsequently, an outer layer cover material having a composition shown in Table 1 was injection-molded around the inner layer cover to thereby form the outer layer cover. Subsequently, ordinary coating was applied to the outer layer cover. In this way, the golf balls of Example 1–5 and Comparative Examples 1–3 were completed. In the case of the golf ball of Example 4, an outer layer cover material having a composition shown in Table 1 was injection-molded directly around the core to complete the golf ball.

The mold used for molding of the inner layer cover in Examples 1–3 and Comparative Example 1 had projections which were formed on the inner wall of the cavity, and thus depressions corresponding to convex ribs were formed on the outer surface of the inner layer cover during molding of the inner cover layer. The outer layer cover material intruded into these depressions, and thus convex ribs were formed in the inner layer cover. The thus-formed convex ribs were arranged in a network pattern of the above-described Arrangement 1 (regular octahedron arrangement).

Example 1 represents a golf ball having a large core; Example 3 represents a golf ball having a small core; Example 2 represents a golf ball having a core of a size between the golf balls of Examples 1 and 3; Example 4 represents a golf ball having an inner layer cover made of polyurethane resin; Example 5 represents a golf ball having a hard core; Comparative Example 1 represents a golf ball whose outer layer cover is softer than the inner layer cover thereof; Comparative Examples 2 and 3 represent a three piece golf ball having no ribs; and Comparative Example 4 represents a two piece golf ball having no ribs.

Subsequently, the thus-obtained golf balls were evaluated in terms of travel performance and hit feel, in accordance with the method described below. The results are shown in Table 2.

Travel performance test:

Each golf ball was hit by a swing robot at the below-described speed, and initial speed, travel distance, and spin were measured.

(1) Driver (W#1), head speed: 45 m/s (HS45), loft: 11°
(2) Driver (W#1), head speed: 35 m/s (HS35), loft: 14°

The driver used in the test was a Tour Stage X100 (product of Bridgestone Sport).

Hit-feel test:

The golf balls were subjected to sensory evaluation test for hit feel in which three professional golfers hit the golf balls with a driver and evaluated hit feel. Evaluation criteria for hit feel are as follows:

◎:Outstanding
○: Excellent
Δ: Good
×: Poor

TABLE 2

| | | Examples | | | | | Comparative Examples | | | |
|---|---|---|---|---|---|---|---|---|---|---|
| Ball configuration | | 1 three layers | 2 three layers | 3 three layers | 4 three layers | 5 three layers | 1 three layers | 2 three layers | 3 three layers | 4 two layers |
| Core | Diameter (mm) | 36.4 | 32.7 | 30.3 | 34.5 | 36.4 | 36.4 | 36.4 | 32.7 | 38.7 |
| | Weight (g) | 29.3 | 21.6 | 16.8 | 25.6 | 29.3 | 29.3 | 29.3 | 21.6 | 35.5 |
| | Specific gravity (g/cc) | 1.160 | 1.180 | 1.150 | 1.190 | 1.160 | 1.160 | 1.160 | 1.180 | 1.170 |
| | Hardness (mm) *1 | 2.8 | 4.2 | 5.5 | 3.4 | 2.2 | 2.8 | 2.8 | 4.2 | 3.4 |
| Inner layer cover | Diameter (mm) | 40.0 | 38.7 | 38.7 | 37.9 | 40.0 | 40.0 | 40.0 | 38.7 | — |
| | Thickness (mm) | 18.0 | 3.00 | 4.20 | 1.70 | 1.80 | 1.80 | 1.80 | 3.00 | — |
| | Weight (g) *2 | 38.5 | 35.4 | 35.5 | 33.7 | 38.5 | 38.5 | 38.5 | 35.4 | — |
| | Specific gravity (g/cc) | 1.120 | 1.150 | 1.190 | 1.160 | 1.120 | 1.120 | 1.120 | 1.150 | — |
| | Shore D hardness | 40 | 43 | 47 | 36 | 40 | 65 | 40 | 43 | — |
| Outer layer Cover | Diameter (mm) | 42.7 | 42.7 | 42.7 | 42.7 | 42.7 | 42.7 | 42.7 | 42.7 | 42.7 |
| | Thickness (mm) | 1.35 | 2.00 | 2.00 | 2.40 | 1.35 | 1.35 | 1.35 | 2.00 | 2.00 |
| | Weight (g) *3 | 45.2 | 45.2 | 45.2 | 45.2 | 45.2 | 45.2 | 45.2 | 45.2 | 45.2 |
| | Specific gravity (g/cc) | 0.970 | 0.970 | 0.970 | 0.970 | 0.970 | 0.970 | 0.970 | 0.970 | 0.970 |
| | Shore D hardness | 65 | 58 | 62 | 58 | 60 | 56 | 65 | 58 | 65 |
| | Rib shape | | | | | | | — | — | — |
| | Width (mm) | 1.00 | 1.50 | 1.00 | 1.00 | 1.50 | 1.00 | — | — | — |
| | Height (mm) | 1.80 | 2.00 | 2.10 | 1.60 | 1.80 | 1.80 | — | — | — |
| | Height/thickness *4 | 1.00 | 0.67 | 0.50 | 0.94 | 1.00 | 1.00 | — | — | — |
| W#1 HS 45 m/s | Spin (rpm) | 2210 | 2380 | 2420 | 2270 | 2500 | 2060 | 2540 | 2610 | 2700 |
| | Initial speed (m/s) | 63.7 | 63.6 | 63.6 | 63.6 | 63.6 | 63.4 | 63.5 | 63.4 | 63.3 |
| | Carry (m) | 209.3 | 208.4 | 209.5 | 209.9 | 209.5 | 202.3 | 208.2 | 207.7 | 202.1 |
| | Total distance (m) | 231.4 | 226.1 | 228.2 | 229.0 | 225.5 | 223.1 | 224.3 | 223.4 | 222.0 |
| | Hit feel | ⊙ | ⊙ | Δ | ⊙ | Δ | X | Δ | Δ | Δ |
| W#1 HS 35 m/s | Spin (rpm) | 3330 | 3640 | 3670 | 3440 | 3730 | 2980 | 3730 | 3770 | 4030 |
| | Initial speed (m/s) | 50.6 | 50.5 | 50.6 | 50.6 | 50.4 | 50.3 | 50.4 | 50.4 | 50.2 |
| | Carry (m) | 145.7 | 146.3 | 147.0 | 146.2 | 146.7 | 143.6 | 146.7 | 146.2 | 142.5 |
| | Total distance (m) | 160.2 | 159.7 | 159.3 | 162.1 | 157.9 | 155.2 | 156.6 | 156.8 | 154.1 |
| | Hit feel | ⊙ | ⊙ | ⊙ | ⊙ | Δ | X | Δ | Δ | X |

*1 Deformation upon application of a load of 100 kg
*2 Core + inner layer cover
*3 Core + inner layer cover + outer layer cover
*4 Height of a rib/thickness of an inner layer cover

What is claimed is:

1. A golf ball comprising at least a core, an inner layer cover and an outer layer cover, in which convex ribs are formed on the inner surface of the outer layer cover such that the convex ribs intrude into the inner layer cover; the hardness of the outer layer cover is greater than that of the inner layer cover; and the convex ribs are arranged in a network pattern such that when the apexes of each spherical triangle of a hypothetical octahedron or icosahedron assumed on the inner surface of the outer layer cover are each represented by A, the center of the triangle is represented by B, the midpoint of each side of the triangle is represented by C, and a point on a line connecting the center B and each apex A is represented by D, a convex rib is arranged along each of a line between point A and point D, a line between point B and point D, and a line between point C and point D.

2. A golf ball comprising at least a core, an inner layer cover and an outer layer cover, in which convex ribs are formed on the inner surface of the outer layer cover such that the convex ribs intrude into the inner layer cover; the hardness of the outer layer cover is greater than that of the inner layer cover; and the convex ribs are arranged in a network pattern such that when the apexes of each spherical triangle of a hypothetical octahedron or icosahedron assumed on the inner surface of the outer layer cover are each represented by A, the center of the triangle is represented by B, the midpoint of each side of the triangle is represented by C, and a point on a line connecting the center B and each apex A is represented by D, a convex rib is arranged along each of a line between point A and point D, a line between point B and point C, and a line between point C and point D.

3. A golf ball comprising at least a core, and an inner layer cover and an outer layer cover, in which convex ribs are formed on the inner surface of the outer layer cover such that the convex ribs intrude into the inner layer cover; the hardness of the outer layer cover is greater than that of the inner layer cover; and the convex ribs are arranged in a network pattern such that when the apexes of each spherical triangle of a hypothetical octahedron or icosahedron assumed on the inner surface of the outer layer cover are each represented by A, the center of the triangle is represented by B, points that trisect each side of the triangle are each represented by E, a convex rib is arranged along each of a line between point A and point E, a line between point B and point E, and a line between point E and another point E.

4. A golf ball comprising at least a core, and an inner layer cover and an outer layer cover, in which convex ribs are formed on the inner surface of the outer layer cover such that the convex ribs intrude into the inner layer cover; the hardness of the outer layer cover is greater than that of the inner layer cover; and the convex ribs are arranged in a network pattern such that when that when the apexes of each spherical triangle of a hypothetical octahedron or icosahedron assumed on the inner surface of the outer layer cover are each represented by A, and the midpoint of each side of the triangle is represented by C, a convex rib is arranged along each of a line between point A and point C, and a line between point C and another point C.

5. A golf ball according to claim 1, wherein the core deforms in an amount of 2.5 to 8.0 mm upon application of a load of 100 kg thereto; the outer layer cover has a Shore D hardness of 56 or greater; and the difference in hardness between the outer layer cover and the inner layer cover is 5 or greater in Shore D hardness.

6. A golf ball according to claim 1, wherein the outer layer cover has a thickness of 0.5 to 3.0 mm, excluding the height of ribs.

7. A golf ball according to claim 1, wherein the ribs have a width of 0.3 to 2.5 mm and a height 0.3 to 1.0 times the thickness of the inner layer cover.

8. A golf ball according to claim 1, wherein the main component of the core is 1,4-cis-polybutadiene; the core has a diameter of 29.0 to 38.0 mm; and the main component of the inner layer cover is a polyester resin or a polyurethane resin.

* * * * *